US009103180B2

(12) United States Patent
Roders et al.

(10) Patent No.: US 9,103,180 B2
(45) Date of Patent: Aug. 11, 2015

(54) DRILLING APPARATUS INCLUDING A FLUID BYPASS DEVICE AND METHODS OF USING SAME

(75) Inventors: Ingo Roders, Seelze (DE); Thorsten Regener, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 1002 days.

(21) Appl. No.: 13/229,099

(22) Filed: Sep. 9, 2011

(65) Prior Publication Data

US 2013/0062124 A1 Mar. 14, 2013

(51) Int. Cl.
*E21B 21/08* (2006.01)
*E21B 21/10* (2006.01)

(52) U.S. Cl.
CPC ..... *E21B 21/103* (2013.01)

(58) Field of Classification Search
CPC ..... E21B 44/00; E21B 21/08; E21B 4/02; E21B 21/106; E21B 21/103; E21B 43/00; F03B 13/02; G05D 7/06; G05D 16/20
USPC ..... 175/25, 46, 48; 700/282
See application file for complete search history.

(56) References Cited

U.S. PATENT DOCUMENTS 4,396,071 A 8/1983 Stephens
7,299,880 B2 11/2007 Logiudice et al.
7,518,950 B2 4/2009 Treviranus et al.
7,806,203 B2 * 10/2010 Krueger et al. ..... 175/57
8,267,197 B2 * 9/2012 Fincher et al. ..... 175/57
2002/0148645 A1 10/2002 Falgout, Sr.
2005/0098349 A1 * 5/2005 Krueger et al. ..... 175/25
2006/0011354 A1 1/2006 Logiudice et al.
2008/0164062 A1 7/2008 Brackin et al.
2008/0196903 A1 8/2008 Wardley et al.
2009/0056952 A1 3/2009 Churchill
2009/0250225 A1 10/2009 Zaeper et al.
2010/0025111 A1 * 2/2010 Gearhart et al. ..... 175/48
2013/0025940 A1 * 1/2013 Grimmer ..... 175/48

OTHER PUBLICATIONS

International Search Report and the Written Opinion dated Feb. 15, 2013 for International Application No. PCT/US2012/053158.

* cited by examiner

*Primary Examiner* — Kenneth L Thompson
*Assistant Examiner* — Michael Wills, III
(74) *Attorney, Agent, or Firm* — Cantor Colburn LLP

(57) ABSTRACT

In one aspect, the disclosure provides a method of drilling a wellbore, which method, in one embodiment, includes the features of drilling the wellbore with a drill string that includes a bypass device having a fluid passage therethrough by supplying a fluid through the bypass device, wherein the drilling fluid circulates to the surface via an annulus between the drill string and the wellbore; defining a time period (locking time); initiating a selected drilling parameter; detecting downhole the selected drilling parameter and one of the second flow rate and a differential pressure; and activating the bypass device when the selected drilling parameter and one of the second flow rate and the differential pressure are present during the defined time period to divert a portion of the drilling fluid from the bypass device to the annuls. In one aspect, the selected drilling parameter is rotation of a member associated with the bypass device.

23 Claims, 5 Drawing Sheets

DRILLING APPARATUS INCLUDING A FLUID BYPASS DEVICE AND METHODS OF USING SAME

BACKGROUND OF THE DISCLOSURE

1. Field of the Disclosure

The present disclosure relates to apparatus and methods for diverting fluid in downhole tool applications.

2. Background

Wellbores are drilled in earth's formations using a drill string to produce hydrocarbons (oil and gas) from underground reservoirs. The wells are generally completed by placing a casing (also referred to herein as a "liner" or "drilling tubular") in the wellbore. The spacing between the liner and the wellbore inside (referred to as the "annulus") is then filled with cement. The liner is perforated to allow the hydrocarbons to flow from the reservoirs to the surface via production equipment installed inside the liner. Some wells are drilled with drill strings that also include a liner. Such drill strings include an outer string that is made with the liner. The inner string is typically a drill string that includes a drill bit, a bottomhole assembly and a steering device. The inner string is placed inside the outer string and securely attached therein at a suitable location. The pilot bit, bottomhole assembly and steering device extend past the liner to drill a deviated well. To drill a wellbore with such a drill string, a drilling fluid (also referred to as "mud") is supplied to the inner string. The drilling fluid discharges at the bottom of the pilot bit and returns via the annulus to the surface. During drilling, both the pilot bit and the reamer disintegrate the rock formation into small pieces referred to as the cuttings, which flow with the circulating fluid to the surface via the annulus between the liner and the wellbore wall. In certain case and particularly in highly deviated wells, the cuttings tend to settle at the low side of the wellbore and the flow rate of the circulating fluid is not adequate to cause the cuttings to efficiently flow to the surface. In other cases, it is desired to reduce pressure at the bottom of the wellbore, referred to as equivalent circulation density ("ECD").

The disclosure herein provides apparatus and methods for drilling wellbore while hole cleaning and for controlling the ECD.

SUMMARY OF THE DISCLOSURE

In one aspect, the disclosure provides a method of drilling a wellbore, which method, in one embodiment, includes the features of drilling the wellbore with a drill string that includes a bypass device having a fluid passage therethrough by supplying a fluid through the bypass device, wherein the drilling fluid circulates to the surface via an annulus between the drill string and the wellbore; defining a time period (locking time); initiating a selected drilling a parameter; detecting downhole the selected drilling parameter and one of the second flow rate and a differential pressure; and activating the bypass device when the selected drilling parameter and one of the second flow rate and the differential pressure are present during the defined time period to divert a portion of the drilling fluid from the bypass device to the annuls. In one aspect, the selected drilling parameter is rotation of a member associated with the bypass device.

In another aspect, an apparatus for use in a wellbore is provided that in one embodiment may include a bypass device having a passage. In one aspect, the bypass device is configured to pass a fluid supplied thereto through the passage when it is in a closed position and divert a portion of the fluid to an annulus between the bypass device and the wellbore when it is in an open position, The apparatus further includes a first sensor configured to determine one of a flow rate and a pressure differential between the fluid in the bypass device and the annulus, a second senor configured to determine a selected parameter, and a controller configured to open the bypass device to divert at least a portion of the fluid from the bypass device to the annulus when the selected parameter and one of the flow rate and differential pressure occur within a selected time period.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

DESCRIPTION OF THE DRAWINGS

For detailed understanding of the present disclosure, references should be made to the following detailed description, taken in conjunction with the accompanying drawings, in which like elements have been given like numerals and wherein.

DETAILED DESCRIPTION OF THE DISCLOSURE

Figure 1:
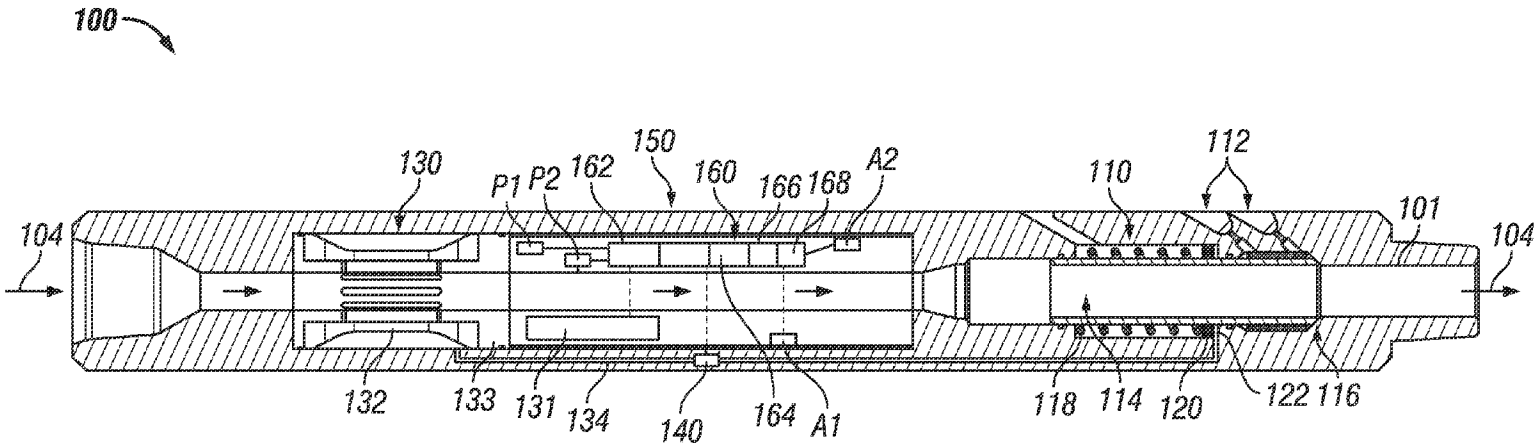
FIG. 1 is a plan view of a bypass valve in a closed position made according to one embodiment of the disclosure.

FIG. 1 is a line drawing of a fluid bypass device 100 (also referred herein as the "flow diverter") in a closed position, made according to one embodiment of the disclosure. In aspects, the bypass device 100 has a passage 101 that allows a fluid 104, such as drilling fluid supplied for the surface, to pass therethrough. The bypass device 100 includes a body 102 that houses a bypass valve 110 that in an open position (also referred to herein as the "activated" position) allows a portion of the fluid 104 to flow from the inside of the bypass device 100 to a location outside the bypass device, such as annulus between the bypass device an a wellbore. The bypass device 100 further includes a hydraulic unit 130 configured to open and close the bypass valve 110 and a control circuit (also referred to herein as the "controller") 150 configured to control the operation of the hydraulic unit 130 in response to one or more parameters of interest. In aspects, the bypass valve 110 includes bypass nozzles 112 that, in an open position, allow a portion of the fluid 104 to flow from inside of the bypass valve 110 to the outside of the bypass valve 110. The bypass valve 110 further includes a bypass sleeve (or sleeve) 114 that is urged against a bypass valve seat (or seat) 116 by a biasing member 118, such as a spring. The hydraulic unit 130 includes a fluid reservoir or source 132 that contains a fluid 133, which fluid may be a substantially non-compressible fluid, such as oil. The fluid 133 in the reservoir 132 is in fluid communication with the sleeve 114 via a fluid line 134. A flow control device 140, such as a two-way valve, in the fluid line 134 controls the flow of the fluid 133 between the bypass valve 110 and the reservoir 132. The control circuit 150, in aspects, may include main electronics 160 and a power source, such as battery. A pair of pressure sensors P1 and P2 associated with the bypass device 100 respectively provide signals relating to pressure of the fluid 104 inside and the medium outside the bypass device 110, which information may be used to determine the flow rate of the fluid through the bypass valve 114 and/or pressure differential between the inside and outside of the bypass device 110 and/or to determine presence variations in the pressure or flow of fluid 104 flowing through the bypass device 100. In aspects, the pressure variations may be induced in the fluid 104 at the surface by a suitable device, including, but not limited to, a mud pump, fluid bypass valve in a line supplying fluid 104 to the bypass device 100 and another device that induces pressure pulses in the fluid (referred to herein as a "pulsers"). Such pulsers may include a rotating pulser, an oscillating pulser, a poppet-type pulser, etc. A differential pressure sensor or another device may also be utilized to determine the pressure differential between the inside and outside of the bypass device 110. The accelerometers A1 and A2 are provided to determine rotation of the bypass device 100 or another member associated therewith, such as a drilling assembly coupled to the bypass device 110. Any other device may also be utilized to determine the rotation, such as hall-effect sensors, magnetically codes sensors, etc. The control circuit 160 may include a circuit 162 for receiving signals from the sensors, such as sensors P1, P2, A1 and A2, condition such signals (such as by pre-amplifying analog signals generated by the sensors) and digitize the conditioned signals. The control circuit 160 may further include a processor 164, such as microprocessor, a storage device 166, such as a solid-state memory and programs and instructions 168, accessible to the processor 164 for processing the digitized signals and controlling the operation of the valve 114 to control the operation of the bypass valve 110. The opening and closing of the bypass valve 110 is described in reference to FIGS. 2-4.

Figure 2:
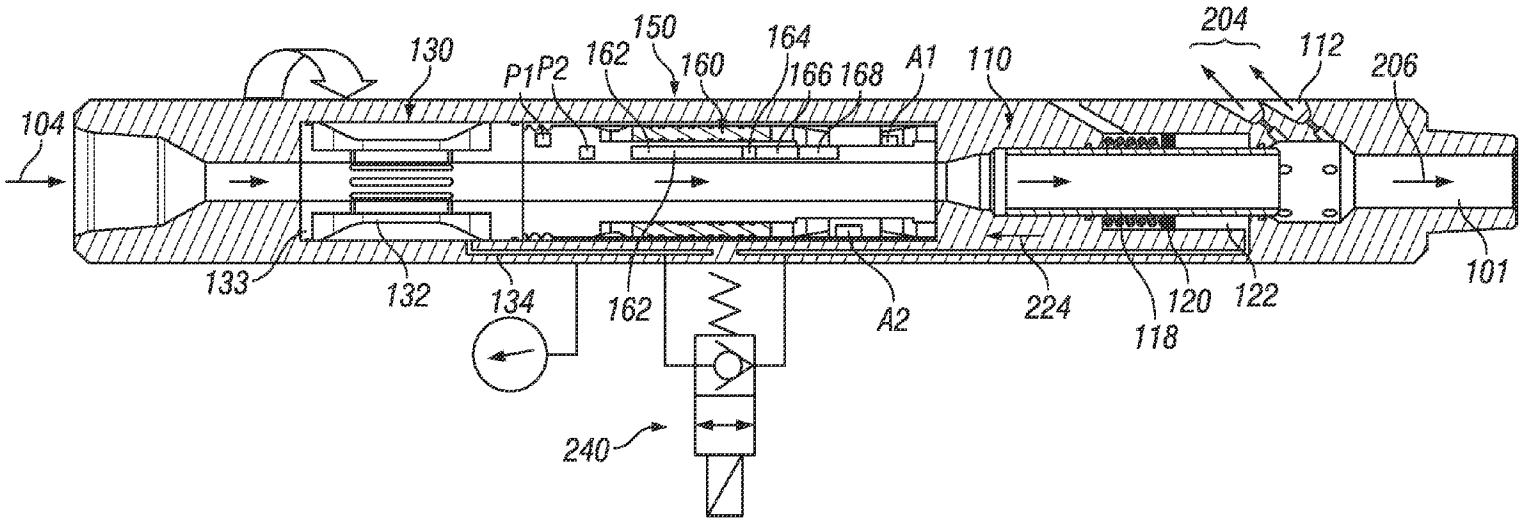
FIG. 2 is a plan view of the bypass valve shown in FIG. 1 in an open position, according to one embodiment of the disclosure.

FIG. 2 is a line drawing of the bypass valve shown in FIG. 1 in an open position, according to one embodiment of the disclosure. To divert or bypass a portion 204 of the fluid 104 flowing through the bypass device 100, the control circuit 160 in response to one or more parameters of interest causes the valve 140 to open, which causes the fluid 133 to flow under pressure from the reservoir 132 to the fluid chamber 122. The fluid entering the chamber 122 causes a piston 120 to compress the biasing member 118, which moves the sleeve 114 away from the seat 116, which opens or activates the bypass valve 110 and allows the portion 204 of the fluid 104 to pass to the outside of the bypass device 100. The internal dimensions of the passage 101 inside the bypass valve 110 may be configured so that the bypass fluid 204 amount depends upon the flow rate of the fluid 104 supplied from the surface. Closing or deactivating the valve 140 releases pressure on the piston 120 applied by the fluid 133 from the chamber 122, which allows the biasing member 118 to move the piston 120 and thus the sleeve 114 toward the seat 116 that closes the bypass valve 110. In another aspect, the hydraulic unit 130 may include a pump operated by a motor configured to pump the fluid 133 into the chamber 122 to controllably divert the drilling fluid 104 from the bypass device 110. In aspects, the valve 140 may be any two-way fluid control device, such as a solenoid valve 240 shown in FIG. 2.

Figure 2A:
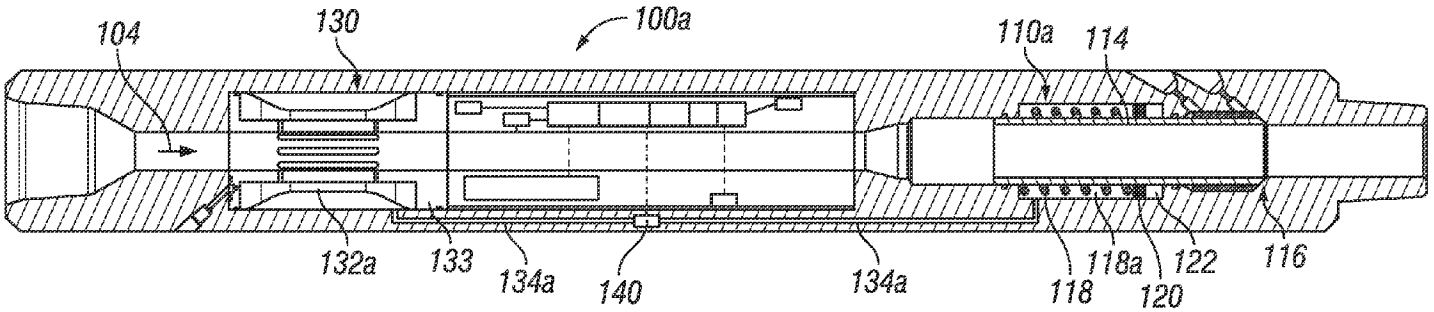
FIG. 2A is a plan view of a bypass valve shown in FIG. 1 that utilizes an alternative mechanism for activating and deactivating the bypass valve.

FIG. 2A is a plan view of a bypass device 100*a*, similar to the bypass device 100 shown in FIG. 1, that utilizes an alternative mechanism for activating and deactivating the bypass valve 110*a*. The bypass device 100*a* includes an oil reservoir 132*a* that is pressure compensated by the annulus pressure. The oil reservoir, therefore, is at a lower pressure than the pressure inside the bypass device 100*a* created by the fluid 104 flowing through the bypass device 100*a*. In this configuration, the piston 120 is biased by the pressure of the fluid 104 flowing through the bypass valve 110*a*, which is higher than the annulus pressure acting on the reservoir 132*a*. To close or deactivate the bypass valve 110*a*, oil 133 from the reservoir 132 is pumped under pressure into the chamber 118*a* containing the biasing member 118 via line 134*a*, while the two-way valve 140 is open (activated). This causes the piston 104 to move to the far right position (as shown in FIG. 2A), which moves the bypass valve sleeve 114 against the bypass valve seat 116, thereby closing the bypass valve 110*a*. The two-way valve 140 is then closed (deactivated), which prevents the fluid in the chamber 118*a* from moving into the reservoir 132*a*, which maintains the sleeve 116 urged against the bypass valve seat. When the two-way valve 140 is opened, the high pressure inside the bypass valve 101*a* acting on the piston 120 moves the piston 120 and thus the bypass sleeve 114 to the left (away from the bypass seat 116), thereby opening the bypass valve 110*a*.

Figure 3:
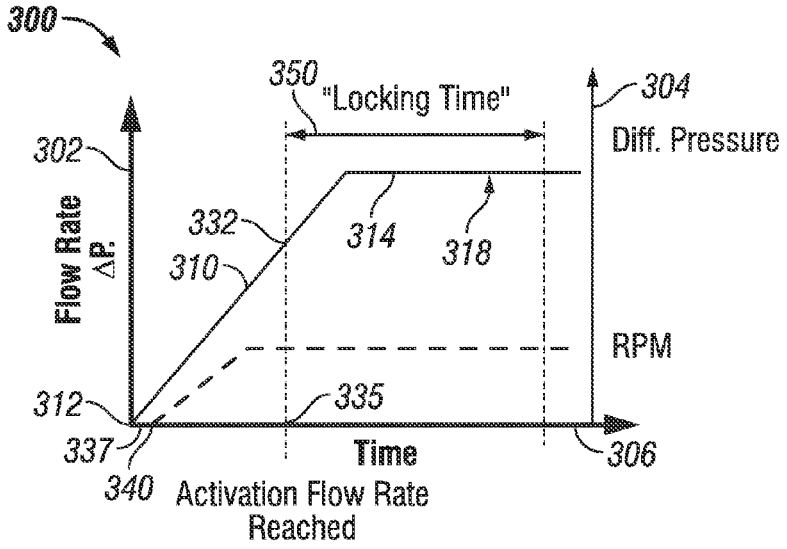
FIG. 3 is graph showing a pressure differential signal and a rotational signal that in combination may be utilized to open the valve of FIG. 1, according to one method of the disclosure.

Still referring to FIGS. 1, 2 and 2A, in aspects, the bypass valve 110 or 110*a* may be opened and closed repeatedly during use of the bypass device 100 downhole. The bypass valve 110 or 110*a* may be opened and closed using one or more parameters or characteristics. In a particular configuration, the parameters may be fluid flow rate or differential pressure between the inside and outside of the bypass device 100 or 110*a* and rotation of the bypass device or another member or device associated therewith. FIG. 3 is a graph 300 that shows the flow rate or differential pressure 310 along the left vertical axis 302, rotational speed (RPM) 320 of a suitable member along the right vertical axis 304 and time along the horizontal axis 306. Referring to FIGS. 2 and 3, to open the bypass device 100 or 110*a*, the flow rate of the fluid 104 is increased from a base level 312 to an upper level 314. As the flow rate 310 is increased, the differential pressure increases, as shown by the rising section 316 of the flow rate or differential pressure curve 310. At the upper level flow rate 314, the curve 310 becomes constant as shown by section 318. In one configuration, the processor 164 may be configured to start a clock or timer 369 when the flow rate/differential pressure 310 reaches a selected level or value 332 at time 335. A short time after starting increasing the flow rate 310, such as shown at time 340 along the axis 306, the bypass device 100 or another member associated therewith is rotated by rotating the drill string to which the bypass device 100 or 100*a* is coupled to a selected value 342. In one aspect, if both the rotational speed 342 and one of the flow rate and differential pressure 310 occur during a defined time period (also referred to herein as the "locking time") 350, the control circuit 160 activates the valve 140, thereby opening the bypass valve 110 or 110*a* to discharge the fluid 204 from the bypass device 100 or 100*a* to the outside. In one aspect, the bypass valve 110 or 110*a* remain open as long as the flow rate remains above a certain low selected level, which level may or may not be the same as the activation flow rate 332. In aspects, the processor 164 may be configured to close the bypass valve 110 when the flow rate is decreased to a predetermined level. In the method described in reference to FIG. 3, the rotation of the string may be stopped, if desired, without, affecting the operation of the bypass device 100. The bypass valve 110, in such a case, may remain upon. In this scenario, the closing of the bypass valve 110 is unaffected by a change in the rotational speed once the bypass valve 110 has been opened. In such a case, the closing of the bypass valve 110 will depend upon the flow rate 310. Also, when the bypass valve 110 or 110*a* is in the closed position and the flow rate reaches the upper level 332 in the locking time 318 and the string rotational speed 320 does not reach the selected value 342, the bypass valve 110 remains closed.

Figure 4:
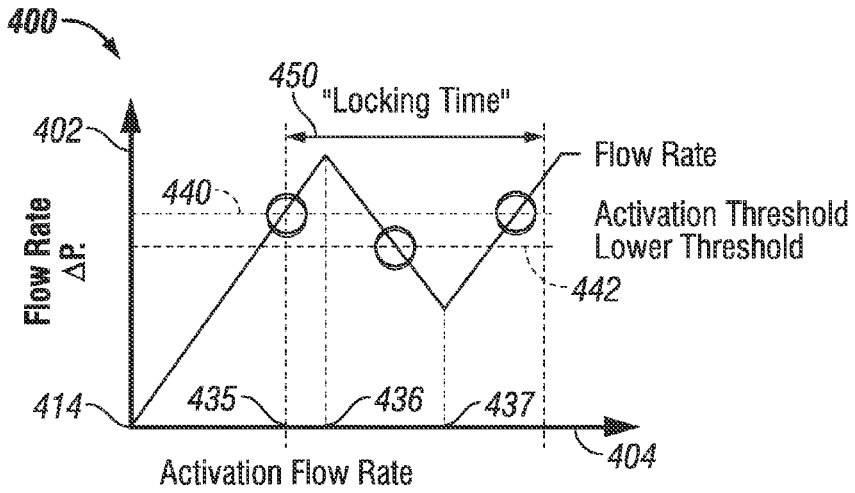
FIG. 4 is graph showing pressure differential signals within a selected time zone that may be utilized to open the valve of FIG. 1, according to another method of the disclosure.

FIG. 4 is graph 400 showing flow rate (or alternatively pressure differential) versus time. Referring to FIGS. 2 and 4, the flow rate or alternatively the pressure differential 410 between the inside and outside of the bypass device 100 or 100*a* is plotted along the vertical axis 402 and the time 435 is plotted along the horizontal axis 404. To open the bypass valve 110 or 110*a*, at time 414 the flow rate 410 is increased so that it passes an activation level 440 at time 335 and reaches an upper value 424. The processor 164 starts the time clock 369 at time 335 when the flow rate or differential pressure 410 reaches the activation level or threshold 440 and starts to count the locking time or time period 450. In other aspects, the locking time 450 may be started prior to or after the flow rate reaches the activation threshold 440. At a certain time after the locking time 450 has started, the flow rate or differential pressure 410 is reduced so that the flow rate or differential pressure 410 falls below a lower level (also referred to as the lower threshold) 442. In one aspect, if the control circuit 160 determines the flow rate or differential pressure 410 has crossed the activation threshold 440 and the lower threshold 442 within the locking time 450, it activates the bypass valve 110. In another aspect, the flow rate or the differential pressure 410 may be increased at time 437 after it has crossed the lower threshold at time 437 to cause it cross the activation threshold 440 at time 438 within the locking time 450. In such a case, the control circuit 160 may be configured to open the bypass valve 110 or 110*a* when the flow rate or differential pressure crosses the activation threshold, lower threshold and again the activation threshold within the locking time 450. Thus in the first case, the flow pattern used by the control circuit 160 to open the valve includes the crossing of the activation threshold and the lower threshold within the locking time. In the second case, the flow pattern includes crossing the activation threshold, lower threshold and then activation threshold within the locking time. Other flow patterns may also be used within a locking time to open the bypass valve 110 or 110*a*. If the bypass valve is closed and the control circuit detects the flow rate has crossed the activation threshold but the defined flow pattern does not occur in the locking time, the control circuit 160 will not open the bypass valve 110 or 110*a*.

Figure 5:
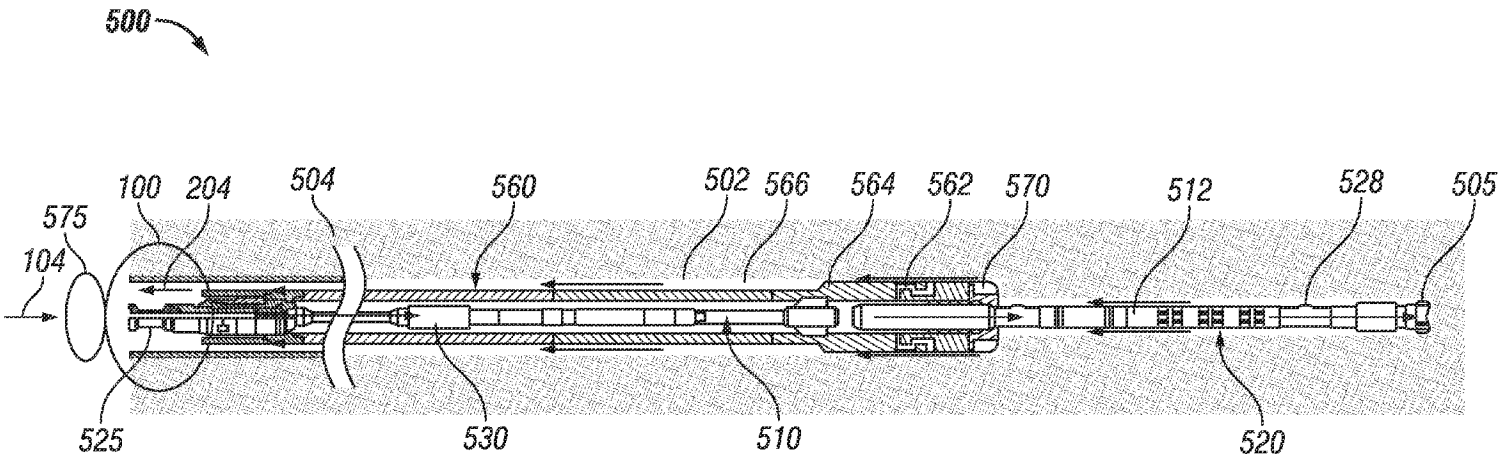
FIG. 5 is an exemplary drill string that may incorporate the bypass device for diverting a portion of the drilling fluid from inside the drill string to an annulus between the drill string and the wellbore.

A bypass device made according to an embodiment of the disclosure may be utilized in any drill string to bypass a fluid flowing through the drill string to the annulus of the wellbore during drilling of a wellbore. FIG. 5 shows an exemplary drill string 500 in which the bypass device, such as device 100 shown in FIG. 1, is placed above or uphole of an exemplary drilling assembly 520. The drill string 500 is shown deployed in a wellbore 502 being formed in a formation 504. The exemplary drilling string 500 includes an inner string 510 and an outer string 560. The inner string 510 includes a pilot drill bit 505 attached to the bottom end of a bottomhole assembly 520 that includes a variety of sensor 512 for providing information about the drilling operations and properties of the formation 504. The inner string 510 runs through the inside of the outer string 560. The inner string 510 is attached to the outer string 560 at a location 562 using a suitable attachment inside the outer string 560 so that the pilot bit 505 and the sensors 512 extend out from the outer string 560. The bottomhole assembly 512 also may include a steering device 528 configured to steer the pilot bit 505 in a particular direction to drill a deviated wellbore. In one aspect, the steering device 528 may include a number of independently operable force application members or ribs that apply varying forces on the wellbore wall to create a force vector along a selected direction to steer the pilot bit 505 along a selected direction. Any other steering device may also be used for the purpose of this disclosure. Such steering devices and sensors 512 are known and are thus not described in detail herein. The inner string 510 also includes a power generation and telemetry unit 530 that provides power to the various components of the bottomhole assembly 520 and two-way data communication between the bottomhole assembly 520 and the surface equipment. The outer string 560 includes a reamer bit 570 at a bottom end thereof. The reamer bit 570 is larger in size than the pilot bit 505 and is used to enlarge the borehole drilled by the pilot bit 505. In one embodiment, the bypass device 100 may be attached at an upper end 525 of the outer string 560. The outer string is connected to drill pipe or drilling tubular 570. The drilling tubular 575 may be rotated at the surface to rotate the drill bit 505 and the reamer bit 570 to form the wellbore 502. The reamer bit 570 is larger that the outer dimension of the tubular 564, which forms an annulus 566 between the outer string 560 and the borehole 502. During drilling of the wellbore 502, the drilling fluid 104 is supplied under pressure from the surface, which fluid discharges at the bottom of the pilot bit 505 and returns to the surface via the annulus 502. When desired, the bypass device 100 or 100*a* is activated to bypass or divert a portion 204 of the fluid 104 from the inside of the inner string 510 to the annulus 502 in the manner described in reference to FIGS. 1-4.

In aspects, the use of a bypass device made according to an embodiment of the disclosure causes fluid to flow through the annulus uphole of the pilot bit 505 and the reamer bit 570. The bypassed fluid 204 aids the flow of the rock cuttings made by the pilot bit 505 and the reamer bit 570 through the annulus 502 and thus improves hole-cleaning during drilling of the wellbore 504. As noted above, the bypass device 100 or 100*a* may be repeatedly activated and deactivated, as desired, during drilling of the wellbore. In other aspects, the drill string embodiments made according the disclosure may include a passage through the bypass device 100 or 100*a* of sufficient dimensions so that an activation device, such as a drop ball, may be dropped from the surface to set or activate a device, such as a setting tool, below (or downhole of) the bypass device 100 or 100*a* Thus, in the configuration of FIG. 5, the wellbore may be drilled with a steerable liner, the hole-cleaning performed by a bypass device and a device downhole of the bypass device may be activated by an activation device, such as drop ball. In other embodiments, the activation device may be a dart of a radio frequency identification device. In other aspects, controllably bypassing the drilling fluid into the annulus allows controlling equivalent circulation density ("ECD") at the bottom of the wellbore. The improved fluid flow through the annulus also can reduce the temperature of the bottomhole assembly 130 (FIG. 2). Additionally, since the bypass device 100 or 100*a* can be activated and deactivated at any time (repeatedly), the bypass flow may be closed when performing functions, such as anchoring a drilling liner in the wellbore, cementing the annulus while the fluid bypass may be resumed for hole-cleaning or ECD control during drilling of the wellbore. The methods and embodiments described herein can achieve high differential pressure across the bypass device 100 or 100*a*, such as 200 bars. In aspects, the devices described herein may be operated with a high total fluid flow rate, such as a total fluid flow rate of 2500 liters per minute (LPM) and an inner string fluid flow rate of 1200 LPM. Such a configuration may allow a bypass fluid flow rate of 1300 LPM. Further, the embodiments and methods described herein utilize operating parameters as signals for activating and deactivation the bypass flow, such as fluid flow rate, differential pressure, and string rotational speed. In other aspects, activation of the bypass device may be defined by any combination of signals, such as fluid flow rate plus string RPM, a flow rate pattern in a locking time, etc. As noted above, the apparatus and methods disclosed herein provide activation-on-demand of the bypass device by utilizing measurements made by downhole sensors in response to surface-sent signals.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. A method of drilling a wellbore, comprising:

drilling the wellbore with a drill string that includes a bypass device having a fluid passage therethrough by supplying a fluid through the bypass device at a first flow rate, wherein the fluid circulates to a surface location via an annulus between the drill string and the wellbore;

altering the flow rate of the fluid to second flow rate;

defining a time period;

rotating the bypass device;

detecting downhole the rotation of the bypass device and one of the second flow rate and a differential pressure; and activating the bypass device to divert a portion of the fluid to the annulus when the rotation of the bypass device and one of the flow rate and the differential pressure are present during the defined time period.

2. The method of claim 1, wherein detecting the rotation of the bypass device further comprises detecting the rotation of the bypass device at a selected rotational speed.

3. The method of claim 2 further comprising altering rotation of the bypass device without deactivating the bypass device.

4. The method of claim 1 further comprising initiating the defined time period when the flow rate of the fluid reaches a selected level.

5. The method of claim 4, wherein defining the time period comprises starting a clock associated with the bypass device and counting the defined time period from the starting of the clock.

6. The method of claim 1 further comprising reducing the flow rate of the fluid to deactivate the bypass device while continuing to flow the fluid to drill the wellbore.

7. The method of claim 1 further comprising providing a first sensor for determining one of the flow rate and pressure differential and a second sensor for determining the rotation of the bypass device.

8. The method of claim 7 further comprising using a processor to determine when: one of the flow rate and the differential pressure is at a selected level; activate a clock to start the defined time period; determine the rotation of the bypass device; and activate the bypass device when both the rotation of the bypass device and one of the flow rate and the differential pressure are present within the defined time period.

9. The method of claim 1 further comprising conveying an activation device through the bypass device to activate a device downhole of the bypass device.

10. The method of claim 9, wherein the activation device is selected from a group consisting of a: drop ball; dart; and radio frequency identification device.

11. The method of claim 1 further comprising:

deactivating the bypass device;

defining another time period;

repeating rotating the bypass device; detecting downhole the rotation of the bypass device and one of the second flow rate and a differential pressure; and activating the bypass device to divert a portion of the fluid to the annulus when the rotation of the bypass device and one of the flow rate and the differential pressure are present during the defined another time period, thereby activating, deactivating and reactivating the bypass device without retrieving the drill string from the wellbore.

12. The method of claim 1, wherein activating the bypass device comprises activating a device selected from a group consisting of a: a hydraulic unit utilizing an oil in a closed loop manner; an electro-mechanical device independent of a fluid flow; and a hydraulic device using the fluid flowing through the bypass device.

13. A method of drilling a wellbore, comprising:

drilling the wellbore with a drill string that includes a bypass device having a fluid passage therethrough by supplying a fluid through the bypass device, wherein the fluid circulates to a surface location via an annulus between the drill string and the wellbore;

defining a time period;

altering the flow rate of fluid according to a selected flow pattern, wherein the flow pattern includes the flow rate crossing a first level and the flow rate crossing a second level within the defined time period;

determining downhole the selected flow pattern; and activating the bypass device to divert the fluid from the drill string to the annulus, when the determined flow pattern occurs within the defined time period.

14. The method of claim 13, wherein the flow pattern further includes the flow rate that again crossing the first level within the defined time period.

15. The method of claim 14 further comprising deactivating the bypass device by reducing the flow rate below the first and second flow levels.

16. An apparatus for use in a wellbore downhole, comprising:

a bypass device having a passage, wherein the bypass device is configured to pass a fluid supplied thereto through the passage when it is in a closed position and divert a portion of the fluid to an annulus between the bypass device and the wellbore when it is in an open position;

a first sensor configured to determine one of a flow rate and a pressure differential between the fluid in the bypass device and the annulus;

a second senor configured to determine a rotation of the bypass device; and a controller configured to open the bypass device to divert the portion of the fluid from the bypass device to the annulus when the rotation of the bypass device and one of the flow rate and differential pressure occur within a selected time period.

17. The apparatus of claim 16, wherein the first sensor includes a pressure sensor and the second sensor includes an accelerometer.

18. The apparatus of claim 17, wherein the controller includes a processor configured to: set the time period in response to one of the flow rate and the differential pressure; open the bypass device when the rotation of the bypass device and one of the flow rate and the differential pressure occur within the selected time period.

19. The apparatus of claim 16, wherein the bypass device further comprises a bypass valve, a hydraulic power unit to open and close the bypass valve and wherein the controller is further configured to control the hydraulic power unit to open and close the bypass valve.

20. The apparatus of claim 16, wherein the controller is further configured to determine when the rotation occurs within the selected time period.

21. The apparatus of claim 16, wherein the controller is further configured to keep the bypass device open when the selected parameter no longer meets a selected criterion and close the bypass device when one of the flow rate and the pressure differential is below a selected level.

22. The apparatus of claim 16 further comprising a drilling assembly downhole of the bypass device.

23. The apparatus of claim 22, wherein the drilling assembly includes an inner string that includes a pilot bit for drilling a pilot hole and an outer string that includes a bit configured to enlarge the pilot hole.

* * * * *